US006241497B1

(12) United States Patent
Mallen

(10) Patent No.: US 6,241,497 B1
(45) Date of Patent: Jun. 5, 2001

(54) COOLING SYSTEM FOR A ROTARY VANE PUMPING MACHINE

(75) Inventor: Brian D. Mallen, Charlottesville, VA (US)

(73) Assignee: Mallen Research Limited Partnership, Charlottesville, VA (US)

( * ) Notice: Subject to any disclaimer, the term of this patent is extended or adjusted under 35 U.S.C. 154(b) by 0 days.

(21) Appl. No.: 09/573,679

(22) Filed: May 19, 2000

Related U.S. Application Data

(62) Division of application No. 09/185,706, filed on Nov. 4, 1998, now Pat. No. 6,086,346.

(51) Int. Cl.[7] ..... F03C 2/00
(52) U.S. Cl. ..... 418/142; 418/259
(58) Field of Search ..... 418/142, 259

(56) References Cited

U.S. PATENT DOCUMENTS 2,762,312 * 9/1956 Adams et al. ..... 418/267
2,861,517 * 11/1958 Neff ..... 418/267
3,645,647 * 2/1972 Ciampa et al. ..... 418/267
4,191,515 * 3/1980 Ettridge ..... 418/142
4,354,808 * 10/1982 Ilg ..... 418/259
4,408,964 * 10/1983 Mochizuki et al. ..... 418/259
4,505,649 * 3/1985 Masuda et al. ..... 418/259

FOREIGN PATENT DOCUMENTS

3309587 * 9/1984 (DE) ..... 418/142
59-101594 * 6/1984 (JP) ..... 418/142
61-083493 * 4/1986 (JP) ..... 418/142

* cited by examiner

*Primary Examiner*—Thomas Denion
*Assistant Examiner*—Theresa Trieu
(74) *Attorney, Agent, or Firm*—Jones Volentine, L.L.C.

(57) ABSTRACT

A rotor and stator cooling system for a rotary vane pumping machine having two end plates, a stator assembly, and a rotor. A rotor cooling gas supplied at a cooling gas supply channel in an end plate passes from a radial inner location, along a rotor face chamber of the rotor in an outward radial direction, and then toward a plurality of rotor gas channels in the rotor. The rotor cooling gas absorbs heat from the rotor and then exits through a heated gas exit channel in another endplate. A stator cooling fluid entering at a cooling fluid port in one end plate passes through stator fluid channels of the stator assembly, absorbs heat therein, and exits at another fluid port in the other endplate.

1 Claim, 8 Drawing Sheets

COOLING SYSTEM FOR A ROTARY VANE PUMPING MACHINE

CROSS REFERENCE TO RELATED APPLICATIONS

This is a divisional application of application Ser. No. 09/185,706, filed Nov. 4, 1998 now U.S. Pat. No. 6,086,346.

BACKGROUND OF THE INVENTION

1. Field of the Invention

The present invention generally relates to rotary vane pumping machines, and more particularly, a rotor and stator cooling system for a rotary vane pumping machine.

2. Description of the Related Art

The overall invention relates to a large class of devices comprising all rotary vane (or sliding vane) pumps, compressors, engines, vacuum-pumps, blowers, and internal combustion engines. Herein the term pumping machine refers to a member of a set of devices including pumps, compressors, engines, vacuum-pumps, blowers, and internal combustion engines. Thus this invention relates to a class of rotary vane pumping machines.

This class of rotary vane pumping machines includes designs having a rotor with slots with a radial component of alignment with respect to the rotor's axis of rotation, vanes which reciprocate within these slots, and a chamber contour within which the vane tips trace their path as they rotate and reciprocate within their rotor slots.

The reciprocating vanes thus extend and retract synchronously with the relative rotation of the rotor and the shape of the chamber surface in such a way as to create cascading cells of compression and/or expansion, thereby providing the essential components of a pumping machine.

Some means of radially guiding the vanes is provided to ensure near-contact, or close proximity, between the vane tips and chamber surface as the rotor and vanes rotate with respect to the chamber surface.

Several conventional radial guidance designs were described in the background section of pending U.S. patent application Ser. No. 08/887,304, to Mallen, filed Jul. 2, 1997, entitled "Rotary-Linear Vane Guidance in a Rotary Vane Pumping Machine" ('304 application). The '304 application describes an improved vane guidance means in order to overcome a common shortcoming of the conventional means of guiding the vanes, namely that high linear speeds are encountered at the radial-guidance frictional interface. These high speeds severely limit the maximum speed of operation and thus the maximum flow per given engine size.

In the improved sliding-vane pumping geometry of the '304 application, multiple vanes sweep in relative motion against the chamber surfaces, which incorporates a radial-guidance frictional interface operating at a reduced speed compared with the tangential speed of the vanes at the radial location of the interface. This linear translation ring interface permits higher loads at high rotor rotational speeds to be sustained by the bearing surfaces than with conventional designs. Accordingly, much higher flow rates are achieved within a given size pumping device or internal combustion engine, thereby improving the performance and usefulness of these machines.

However, even with the above advantages, efforts continue in order to further refine and enhance the performance of the rotary machine. One particular goal is to devise a rotor and stator cooling system that carries away the heat produced by combustion, compression or friction without interfering with any of the elements undergoing complex moving interactions in such a rotary vane pumping machine. For example, the rotor is moving inside the stator at the hottest portions of the rotary vane pumping machine, and the linear translation rings are moving in the end plates between the hottest portions of the engine and the cooling plates of the engine. Forming cooling channels in the rotor and stator, and moving coolant fluids through those channels without interfering with the machines operation, presents a unique and difficult challenge.

In addition, the rotor and stator cooling system should properly match the distribution of heat generated in a rotary vane pumping machine during operation. For an engine, the greatest heat is produced in the vicinity of the combustion residence chamber, while, for a pump, heat generation is expected to be greatest in a compression region of the stator.

SUMMARY OF THE INVENTION

Accordingly, the present invention is directed to a rotary vane pumping machine that substantially overcomes one or more of the problems due to the limitations and disadvantages of the related art.

It is an object of the present invention to provide a cooling system for a rotary vane pumping machine that is properly matched to the distribution of heat generated during normal operations, while at the same time not interfering with the precision operation of the interacting moving elements of the rotary vane pumping machine.

It is another object of the present invention to provide a cooling system for cooling the rotating components of the machine without requiring complex rotating cooling seals.

It is another object of the present invention to provide a cooling system capable of efficiently removing excess heat from a rotary vane internal combustion engine.

In the present invention, a geometry is employed utilizing reciprocating vanes which extend and retract synchronously with the relative rotation of the rotor and the shape of the chamber surface in such a way as to create cascading cells of compression and/or expansion, thereby providing the essential components of a pumping machine.

More specifically, the present invention provides a rotor and stator cooling system matched to the distribution of heat generated in a rotary vane engine, while at the same time, not interfering with the operation of the complex moving interactions among the many components of the rotary vane engine. Furthermore, the present invention utilizes the unique geometries of the rotary vane engine to enhance the flow of coolant fluids through the engine.

To achieve these and other advantages and in accordance with the purpose of the invention, a rotor cooling system for a rotary vane pumping machine, having intake and exhaust end plates and a rotor, includes rotor cooling gas supply channels in the intake and exhaust end plates and a heated gas exit channel in the exhaust end plate. A rotor face chamber is disposed at each axial face of the rotor facing toward the respective end plates, in flow communication with the rotor cooling gas supply channels, such that a rotor cooling gas enters the chamber at an entry radius. A plurality of rotor gas channels, in flow communication with the rotor face chamber, are formed axially through the rotor, and spaced radially inward from an outer edge of the rotor, but radially outward from the entry radius. The rotor face chambers at opposite axial faces of the rotor are connected via the rotor gas channels. The rotor face chambers are also connected to a rotor heated gas exit port. Thus, in such a rotor cooling system, a rotor cooling gas supplied at the cooling gas supply channel passes axially into the rotor face chamber, and then flows in an outward radial direction from the cooling gas supply channel toward the rotor gas channels, while absorbing heat from the rotor. The rotor cooling gas then exits through the rotor heated gas exit port at a exit radius greater than the entry radius.

The rotor cooling system also includes an intake linear translation ring disposed within the intake end plate and an exhaust linear translation ring disposed within the exhaust end plate. The first rotor cooling gas supply channel extends axially through a fixed hub of the intake linear translation ring, between the axis of rotation of the rotor and the intake linear translation ring. The second rotor cooling gas supply channel extends axially through a fixed hub of the exhaust linear translation ring, between the axis of rotation of the rotor and the exhaust linear translation ring.

The rotor cooling system further includes an intake cooling plate adjacent an outer axial side of the intake end plate, and an exhaust cooling plate adjacent an outer axial side of the exhaust end plate. A first rotor cooling gas supply port is formed in the intake cooling plate and extends axially therethrough, in flow communication with the first rotor cooling gas supply channel. A second rotor cooling gas supply port is formed in the exhaust cooling plate and extends axially therethrough, in flow communication with the second rotor cooling gas supply channel. A rotor heated gas exit port is formed in one of the intake cooling plate and exhaust cooling plate, in flow communication with the rotor heated gas channels.

In another aspect of the invention, the cooling system includes a recirculation pipe connecting the heated gas exit port with the cooling gas supply port. A heat exchanger, disposed in a recirculation flow path through the recirculation pipe, reduces the temperature of the cooling gas exiting the heated gas exit port. A cooling fluid supply is in flow communication with the recirculation pipe. Thereby, the cooling gas is recirculated without polluting the atmosphere.

In another aspect of the invention, a stator cooling system of the present invention includes stator fluid channels formed axially through the stator assembly and arranged radially outward of the inner radial surface of the stator cavity. End plate cooling fluid channels, in flow communication with the stator fluid channels, are formed axially through the intake end plate. End plate heated fluid channels, in flow communication with the stator fluid channels, are formed axially through the exhaust end plate. The stator and end plate cooling fluid follows a flow path from the end plate cooling channels, through the stator fluid channels, and then through the end plate heated fluid channels.

BRIEF DESCRIPTION OF THE DRAWINGS

The foregoing and other objects, aspects, and advantages will be described with reference to the drawings, certain dimensions of which have been exaggerated and distorted to better illustrate the features of the invention, and wherein like reference numerals designate like and corresponding parts of the various drawings, and in which.

DETAILED DESCRIPTION OF THE INVENTION

Reference will now be made in detail to embodiments of a rotary pumping machine incorporating a cooling system, examples of which are illustrated in the accompanying drawings. The embodiments described below may be incorporated in all rotary-vane or sliding vane pumps, compressors, engines, vacuum-pumps, blowers, and internal combustion engines, i.e., in all rotary vane pumping machines.

U.S. patent application Ser. No. 08/887,304, to Mallen, filed Jul. 2, 1997, entitled "Rotary-Linear Vane Guidance in a Rotary Vane Pumping Machine" ('304application), is hereby incorporated by reference in its entirety. For ease of discussion, certain portions of the '304 application will be reiterated below where appropriate.

As described herein, the terms "intake" and "exhaust" as used in connection with the end plates and cooling plates of the present invention generally refer to the flow of the cooling fluid or the cooling gas through the engine, and not necessarily to the intake and exhaust sections of the vane cells themselves.

Also, the terms "heated" or "cooling" used in connection with the channels and ports of the present invention are for descriptive clarity, and are not meant to suggest some form of external heating being applied to the "heated" channels or ports. In other words, the "heated" channels or ports are generally warmer than the "cooling" channels or ports, although both are performing a cooling function.

Figure 1A:
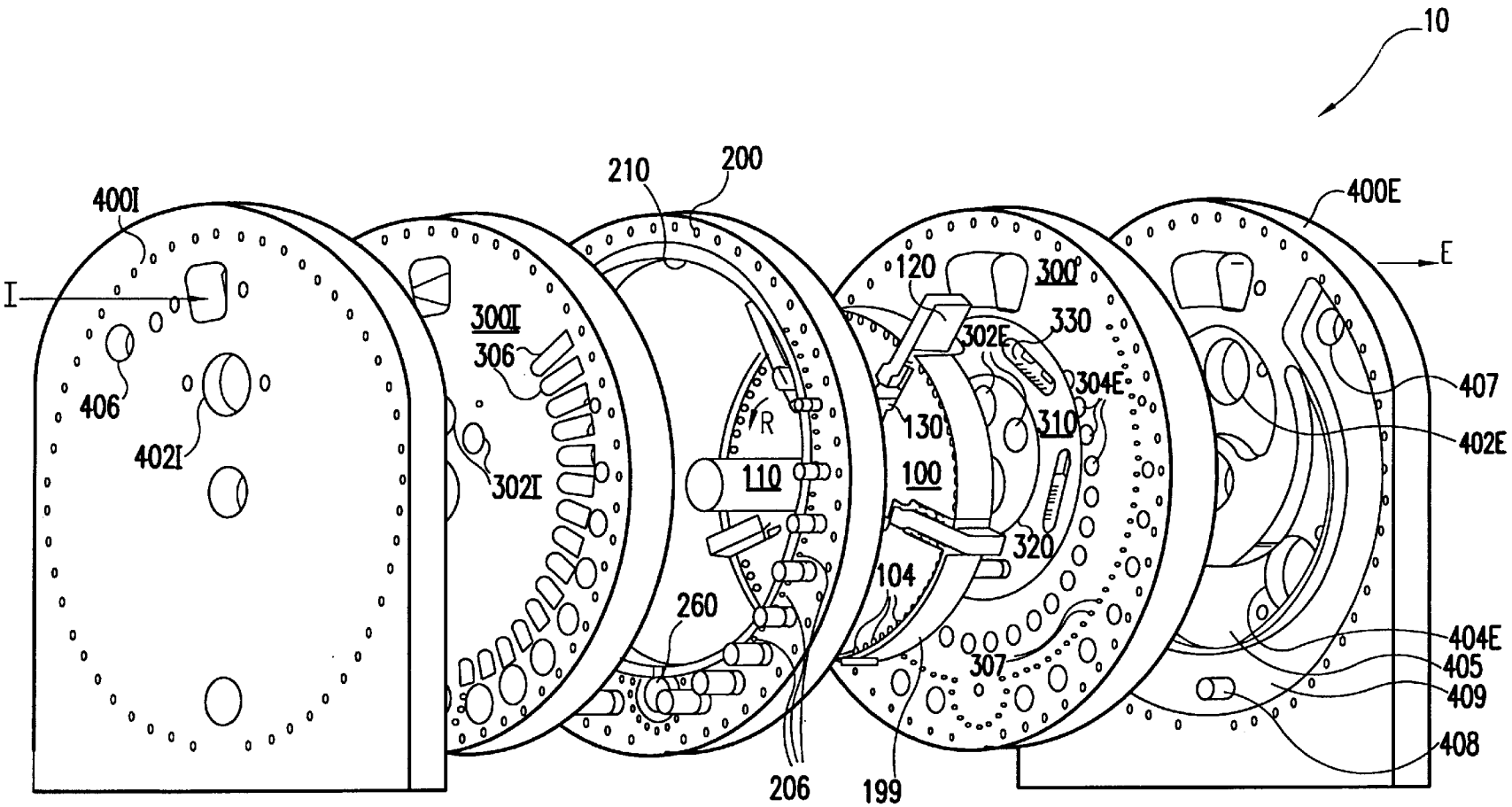
FIG. 1A is an exploded perspective view of a rotary-vane pumping machine in accordance with the present invention.

An exemplary embodiment of the rotary engine assembly incorporating a rotary-linear vane guidance mechanism and cooling system is shown in FIG. 1A and is designated generally as reference numeral 10.

The engine assembly 10 contains a rotor 100, with the rotor 100 and rotor shaft 110 rotating about a rotor shaft axis in a counterclockwise direction as shown by arrow R in FIG. 1A. It can be appreciated that when implemented, the engine assembly 10 could be adapted to allow the rotor 100 to rotate in a clockwise direction if desired. The rotor 100 has a rotational axis, at the axis of the rotor shaft 110, that is fixed relative to a stator cavity 210 contained in a stator assembly 200.

The rotor 100 houses a plurality of vanes 120 in vane slots 130, wherein each pair of adjacent vanes 120 defines a vane cell 140 (see FIG. 2), with the stator contour forming an approximately circular shape.

Figure 3:
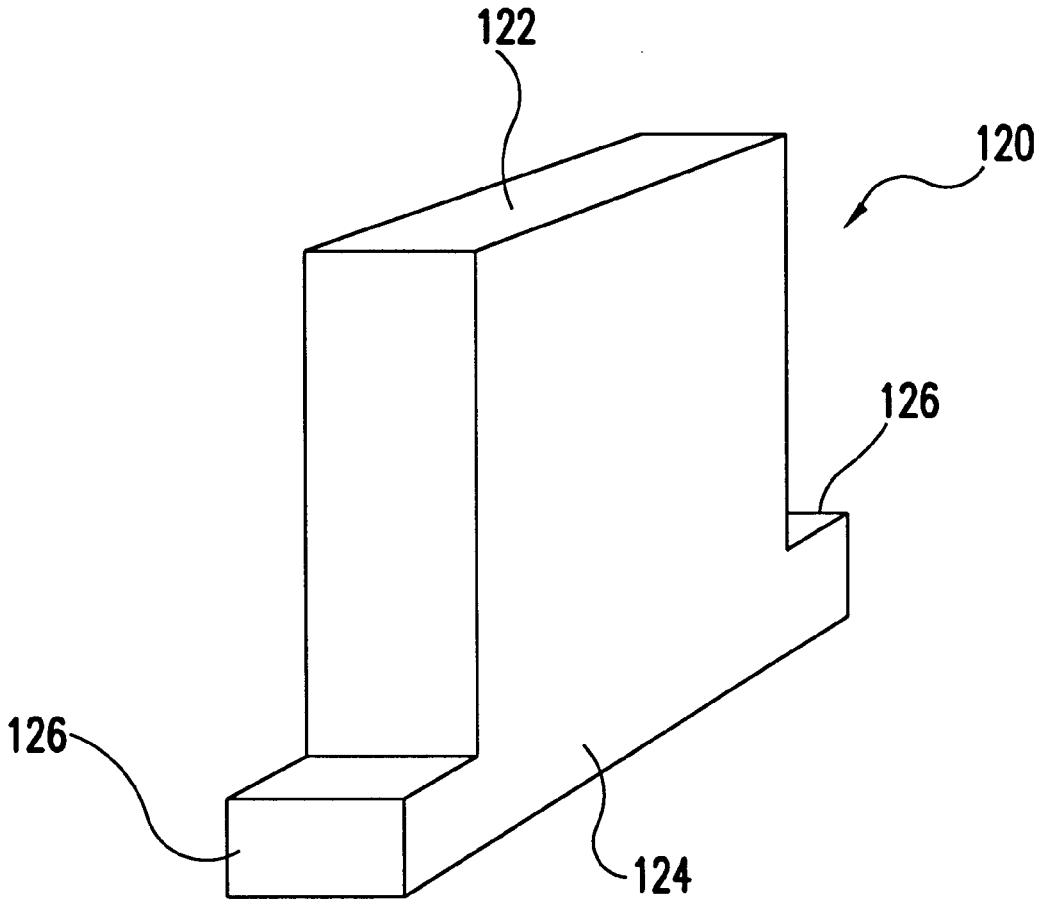
FIG. 3 is a perspective view of one embodiment of the vane employed in the present invention.

Each of the vanes 120 has a tip portion 122 and a base portion 124, with a protruding tab 126 extending from either or both axial ends near the base portion 124 as shown in FIG. 3. While the tip portion 122 of the vane in FIG. 3 is rectangular, the invention is not limited to such a design, it being understood that the vane tip portion may take on many shapes within the scope of the invention. The tip portion may contain one or more sealing tips. As an example, a triangular shaped vane tip would provide a single sealing tip at the apex of the tip portion, whereas the rectangular tip portion 122 in FIG. 3 would provide two sealing tips. The multiple sealing tips of a vane need not all contact the stator contour at the same time, and the sealing tip or tips need not be symmetrical with respect to the vane centerline.

Figure 2:
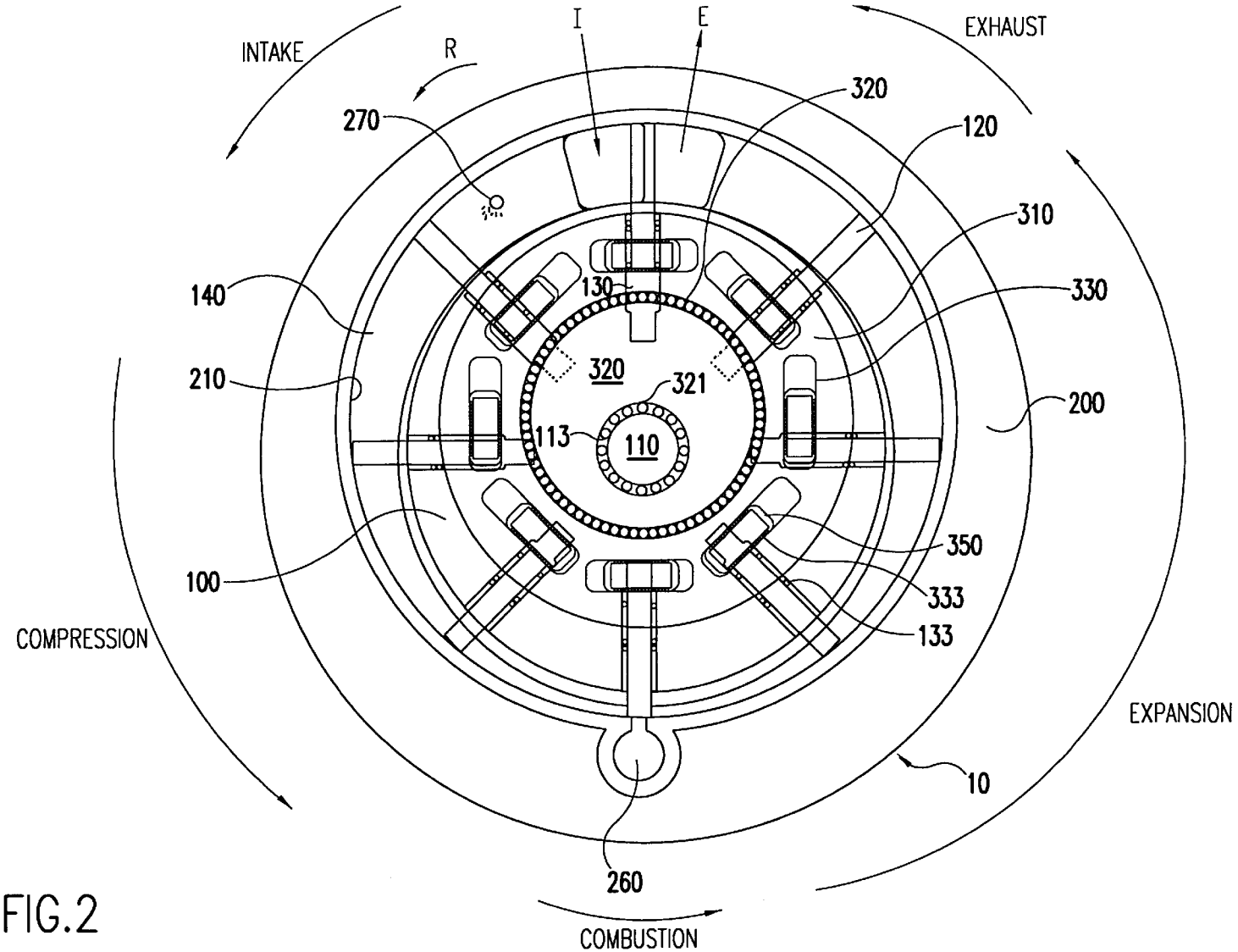
FIG. 2 is a side sectional view of a rotary-vane pumping machine in accordance with the present invention.

As shown in FIGS. 1A and 2, an end plate 300 is disposed at each axial end of the stator assembly 200. The end plate 300 houses a linear translation ring 310, which spins freely around a fixed hub 320. The central axis 321 of the fixed hub 320 is eccentric to the axis of rotor shaft 110 as best seen in FIG. 2. The linear translation ring 310 may spin around its hub 320 utilizing any type of bearing at the hub-ring interface including for example, a journal bearing of any suitable type and an anti-friction rolling bearing of any suitable type.

The linear translation ring 310contains a plurality of linear channels 330. The linear channels 330 allow the vanes to move linearly as the linear translation ring 310 rotates around the fixed hub 320.

In operation, each of the pair of protruding tabs 126, extending from each of the plurality of vanes 120, communicates with a respective linear channel 330 in the translation ring. That is, one protruding tab 126 communicates with a linear channel 330 in the linear translation ring 310 located at one axial end of the engine assembly, and the other protruding tab 126 communicates with a linear channel 330 in the linear translation ring, 310 located at the other axial end of the engine assembly.

Though the machine 10 could operate successfully with the tabs 126 on only one side of the vanes 120 and communicating with only one linear translation ring 310, the best performance is obtained by the balanced, two-ended arrangement described above, namely, a linear translation ring 310 located at each axial end of the machine 10 and protruding tabs 126 communicating with each.

In operation, the rotor 100 rotation causes rotation of the vanes 120 and a corresponding rotation of each linear translation ring 310. The protruding vane tabs 126 within the linear channels 330 of the linear translation rings 310 automatically set the linear translation rings 310 in rotation at a fixed angular velocity identical to the angular velocity of the rotor 100. Therefore, the linear translation ring 310 does not undergo any significant angular acceleration at a given rotor rpm.

Also, the rotation of the rotor 100 in conjunction with the linear translation rings 310 automatically sets the radial position of the vanes at any rotor angle, producing a single contoured path as traced by the vane tips 122 resulting in a uniquely shaped stator cavity 210 that mimics and seals the path traced by the vane tips. Depending on the configuration of the vanes 120 and the stator cavity 210, each linear channel 330 in the linear translation ring 310 may have an outer radial wall and an inner radial wall that interface with the tabs, or the linear channel 330 can have a single inner wall or surface that serves as the outer surface of the linear translation ring 310 itself.

Referring again to FIG. 1A, note that no gearing is needed to maintain the proper angular position of the linear translation rings 310 because this function is automatically performed by the geometrical combination of the tabs 126 within the linear channels 330 of the linear translation rings 310, the radial motion of the vanes 120 within their rotor slots 130, the rotor 100 about its shaft 110 axis, and the translation ring hub 320 about its offset axis 321.

With this unique geometry of the present invention, the linear channels 330 are not exposed to the engine chamber, i.e., the cascading vane cells 140 of a rotary vane engine, and can thus be lubricated with, for example, oil, oil mist, dry film, grease, fuel, fuel vapor or mist, or a combination thereof, without encountering major lubricant contamination problems. More specifically, as best shown in FIG. 2, the outer surface 199 of the rotor 100 forms the inner-radial boundary of the vane cell 140. The outer surface 199 acts as a barrier, preventing any major contaminants from entering the vane cell 140. In other words, the outer surface 199 of the rotor 100 isolates the following moving parts from the vane cells 140: (i) the linear channels 330 and its rollers 333, if any; (ii) vane slots 130 and their rollers 133, if any; (iii) the hub 320 and its rollers 123, if any; (iv) the rotor axis 110 and its rollers 113, if any; and (v) rotor thrust bearings (described later), if any. As will be discussed later, this unique geometry is advantageous in that it allows the rotary machine to use the same fluid or fluid mixture to both cool and lubricate these moving parts.

As shown in FIGS. 1A and 2, a combustion residence chamber 260 may be provided in the stator assembly 200 for the internal combustion engine application. The combustion residence chamber 260 is a cavity or series of cavities within the stator assembly 200, radially and/or axially disposed from a vane cell 140, which communicates with the air or fuel-air charge at about peak compression in the engine assembly. The combustion residence chamber 260 may create an extended region in communication with the vane cell 140 during peak compression.

The particular parameters of such an extended region (e.g., the compression ratio, vane rotor angle, number of vanes, combustion residence chamber position and volume) may vary considerably within the practice of this invention. What is important in an internal combustion engine application is that there is a sufficient duration to the combustion region so that there is adequate time to permit near-complete combustion of the fuel. The combustion residence chamber, by retaining a hot combusted charge in its volume, permits very lean mixtures to be combusted. This feature permits very low pollution levels to be achieved, as more fully described in U.S. Pat. No. 5,524,586 (the '586 patent), and issued U.S. application Ser. No. 08/774,275, of Mallen et al., filed Dec. 27, 1996, and entitled "Method of Reducing Pollution Emissions in a Two-Stroke Sliding Vane Internal Combustion Engine" (the '275 application).

When the present invention is utilized with internal combustion engines, one or more fuel injecting devices 270 (FIG. 2) may be used and may be placed on one or both axial ends of the chamber and/or on the outer or inner circumference to the chamber. Each injector 270 may be placed at any position and angle chosen to facilitate equal distribution within the cell or vortices while preventing fuel from escaping into the exhaust stream. The injector(s) 270 may alternatively be placed in the intake port air flow as more fully described in the '586 patent and the '275 application.

As shown in FIG. 1A, a pair of cooling plates 400 encase the machine 10, provide ports for the cooling system, and serve as an attachment point for various devices used to operate the machine or engine 10. Although shown and described as separate structures in FIG. 1A for ease of illustration, one of ordinary skill in the art would understand that the separate features and functions of the cooling plates 400 and the end plates 300 could be combined into a single structure disposed at each axial end of the machine.

The illustrated internal combustion engine embodiment employs a two-stroke cycle to maximize the power-to-weight and power-to-size ratios of the engine. The intake of the fresh air I and the scavenging of the exhaust E occur at the regions as shown in FIG. 1A and FIG. 2. One complete engine cycle occurs for each revolution of the rotor 100. In the combustion engine embodiment of FIG. 1A, the two cooling plates 400 include a cooling plate 400I associated with air/fuel intake, and another cooling plate 400E associated with combustion product exhaust. Similarly, an end plate on the intake side 300I is adjacent to the intake cooling plate 400I while an end plate on the exhaust side 300E is adjacent to the exhaust cooling plate 400E.

The Cooling System

Figure 1B:
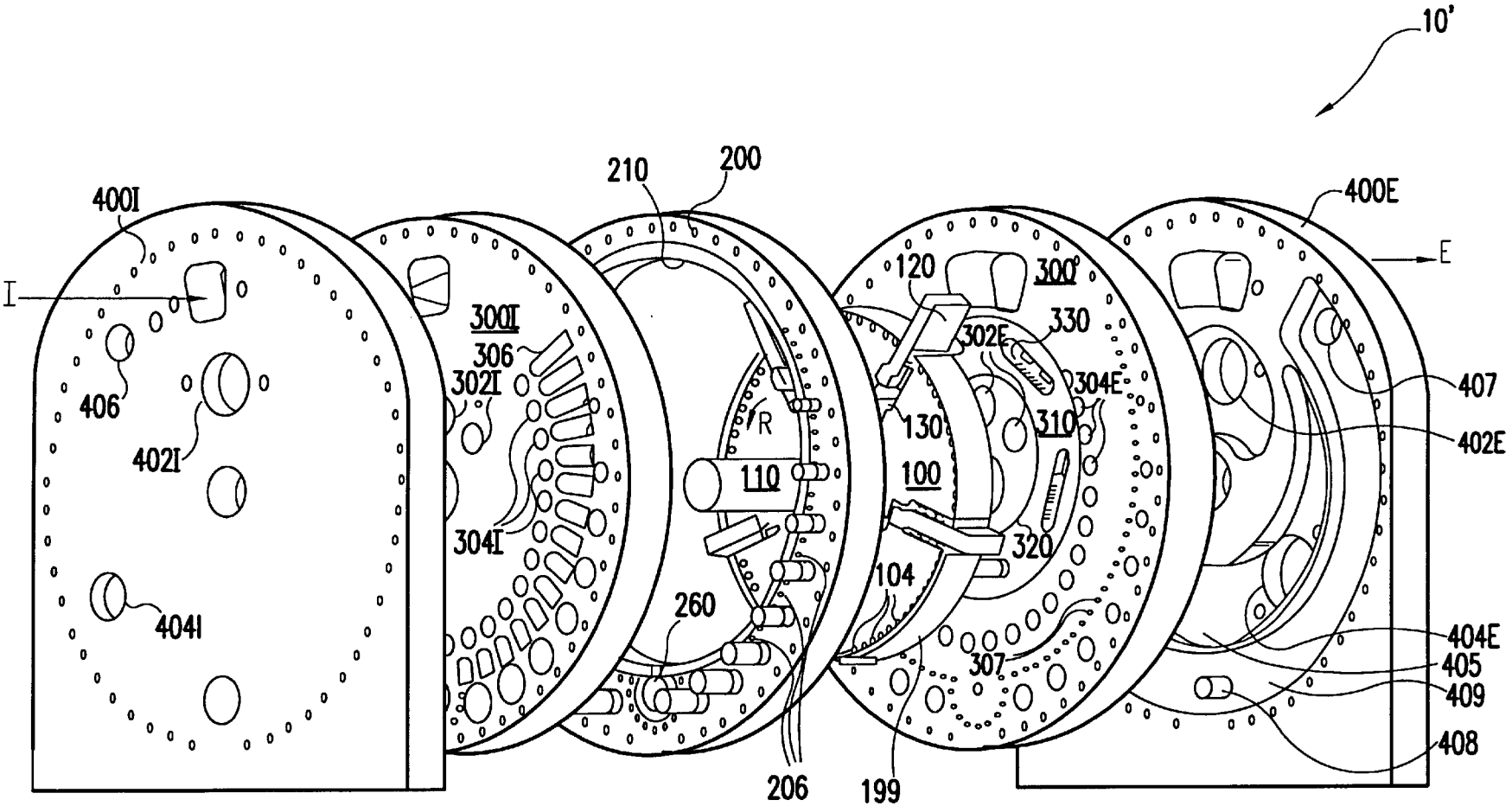
FIG. 1B is an exploded perspective view of a rotary-vane pumping machine in accordance with an alternate embodiment of the present invention.

Referring generally to FIG. 1A and FIG. 1B, the cooling system for the rotary vane pumping machine of the present invention is designed to cool either the rotor 100 and associated moving parts, or the stator assembly 200, or both, depending on the operation of the rotary vane pumping machine. This is because in the unique geometry of the present invention, the rotor 100 and stator assembly 200 provide important inward and outward radial boundaries to the vane cells 140 where compression or combustion, or both, may generate extra heat.

Rotor Cooling System

The mechanism for cooling the rotor 100 and the associated inner rotational parts without requiring complex rotating cooling seals, and for lubricating them simultaneously with a mist, will be described first.

According to the present invention, the rotor 100 is cooled using a cooling gas such as air or air mixed with a lubricating mist. In general, the rotor cooling system delivers the cooling gas from outside the rotary vane pumping machine to the axial faces of the rotor 100 and into close proximity with the rotor's radially outermost surface, i.e., the outer circumferential surface 199 of the rotor that provides a radial inner boundary to the vane cells 140. Simultaneously, the rotor cooling system avoids interfering with the function of the moving rotor, while cooling and lubricating any interacting parts such as the linear translation rings, its linear channels, and the vanes. The elegance of the design avoids having to incorporate complex rotating cooling seals in the engine geometry.

FIG. 1A illustrates an embodiment were the rotor cooling gas enters from both axial ends and is exhausted from one axial end. FIG. 1B illustrates an embodiment where the rotor cooling gas enters from both axial ends and is exhausted from both axial ends.

Generally, in the rotor cooling embodiments of FIGS. 1A and 1B, a cooling gas is supplied at a rotor cooling gas supply port 402 in a cooling plate 400, passes axially through rotor cooling gas channels 302 in an end plate 300, enters a rotor face chamber 101 at an entry radius near the rotor shaft 110 (see FIG. 4), flows in a radially outward direction toward a plurality of rotor gas channels 104 while absorbing heat from the rotor 100, and exits axially through a rotor heated gas exit port 404 in another cooling plate 400 via a plurality of rotor heated gas channels 304 in another end plate 300. Preferably, as shown in FIG. 1A, flow through the rotor gas channels 104 is achieved by locating the rotor heated gas exit port 404 on the opposite axial side of the rotor 100 from the rotor cooling gas supply port 402. More preferably, an external blower is used to force the rotor cooling gas axially through the engine 10.

Because the unique geometry of the invention allows the use of a gas to cool the rotor, several benefits accrue. First, rotating components of the rotor can be cooled without using complex rotating cooling seals. Second, the inertia of the gas is low enough to avoid transmitting momentum or drag between moving components. Third, since the gas is flowing over the moving parts with rolling bearings, and since high speed rolling bearings are better lubricated with a lubricating mist than with a liquid, the lubricating mist can be carried by the rotor cooling gas. The moving parts with rolling bearings that are reached by the cooling gas may include the rotor shaft 110, the vane slots 130, the linear translation ring 310, the linear channels 330, and the thrust bearings 170 described later (see FIG. 5.)

More specifically, the rotor cooling system will be described in terms of channels formed through the. various parts of a rotary vane pumping machine, as embodied in a rotary vane engine 10. A useful frame of reference for the discussion is provided by recognizing that the channels connect ports in the cooling plates 400 with the axial faces of the rotor 100, so that the channels carry the rotor cooling gas axially through the pumping machine. The embodiment 10 of FIG. 1A will be described first, with a comparison to the different features in the embodiment 10' of FIG. 1B were appropriate.

In FIG. 1A, the rotor cooling gas enters from both axial ends and is exhausted from one axial end. The rotor cooling gas is provided to the rotary vane pumping machine 10 through a rotor cooling gas supply port 4021 in an intake cooling plate 400I, and a rotor cooling gas supply port 402E in an exhaust cooling plate 400E. One cooling plate has a rotor heated gas exit port 404, e.g., an exhaust cooling plate heated gas exit port 404E, which allows the rotor cooling gas to carry heat away from the machine 10 after the rotor cooling gas absorbs the heat generated by the rotor 100.

Figure 4:
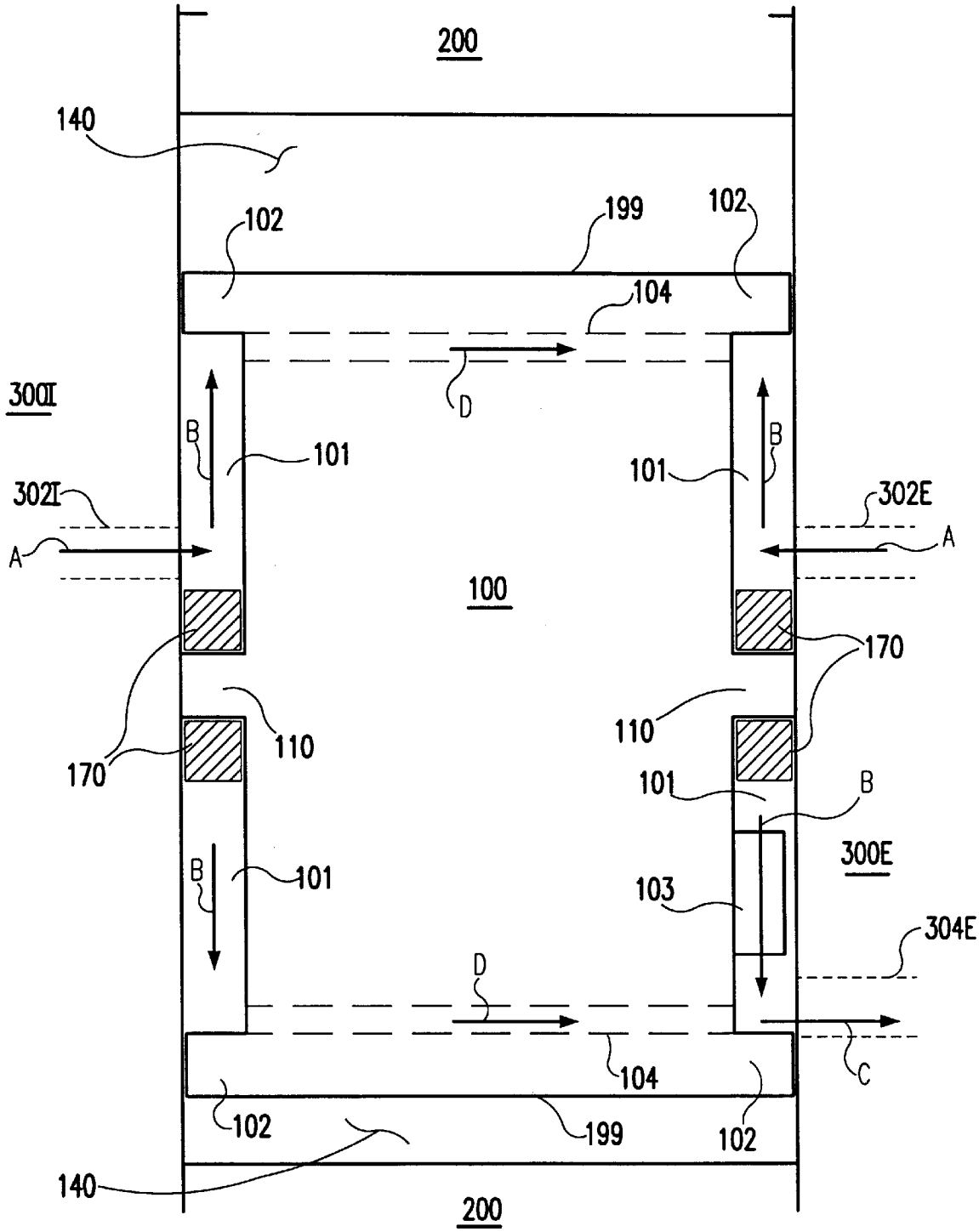
FIG. 4 is a schematic axial cross section through the rotor and the corresponding faces of both end plates according to the embodiment of FIG. 1A of the present invention.

The axial faces of the rotor 100 are recessed to form rotor face chambers 101 (see FIG. 4) between the rotor 100 and the adjacent plate (whether a cooling plate 400 or an end plate 300) in which rotor cooling gas can circulate and efficiently absorb heat from the rotor 100. The unique geometry of the present invention takes advantage of centrifugal pumping, i.e., the tendency for a spinning gas to move radially outward from an axis of rotation, by introducing the rotor cooling gas through a channel 302 at an entry radius close to the axis of rotation of the rotor, and by providing an escape path through another channel (i.e., rotor gas channels 104) positioned radially outward of the entry radius. FIG. 4 depicts rotor face chambers 101 on both axial sides of the rotor 100, to accommodate the rotor cooling gas introduced from both axial sides. Of course, in an alternate embodiment, rotor cooling gas could be introduced from only one axial side.

Referring to FIG. 1A and FIG. 4, the rotor cooling gas flow will be described in greater detail. The rotor cooling gas is introduced to the respective rotor face chambers 101 from the rotor cooling gas supply ports 402I, 402E through at least one rotor cooling gas channel 302I, 302E in each hub 320 of the respective intake and exhaust end plates 300I, 300E. In FIG. 1A, more than one rotor cooling gas channel 302I, 302E are shown in each respective end plate 300I, 300E. Note that the rotor cooling gas channels 302I, 302E are positioned radially inward of the linear translation rings 310. This positioning is advantageous in that the rotor cooling gas is introduced close to the axis of rotation of the rotor 100, while not interfering with the function of the linear translation rings 310.

Figure 5:
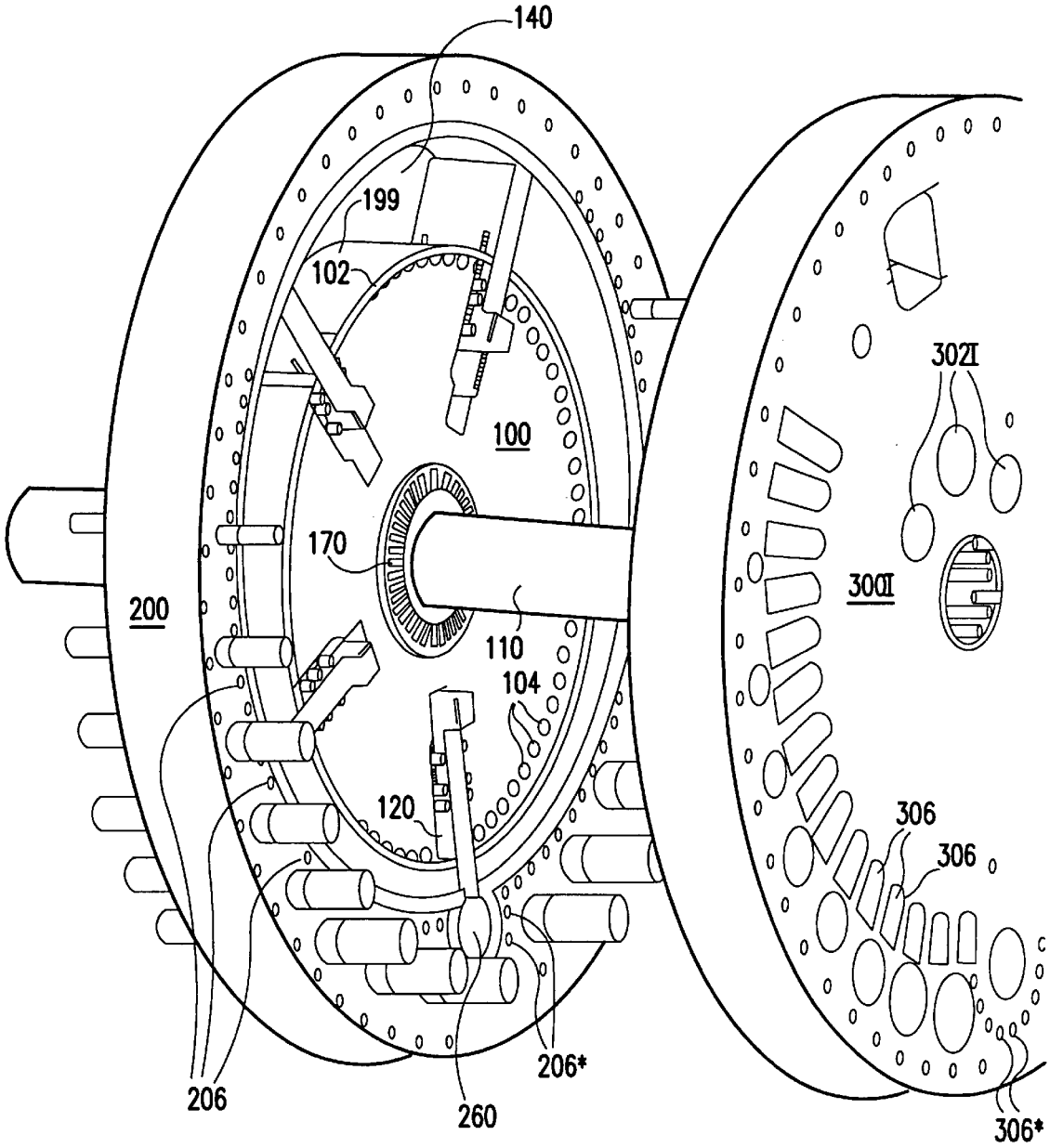
FIG. 5 is a partly exploded perspective view of the stator, the rotor, and the end plate on the intake side of the engine according to the embodiment of FIG. 4.

The rotor 100 includes a plurality of rotor gas channels 104 positioned radially outward of the rotor cooling gas channels 302. The rotor gas channels 104 pass axially through the rotor 100 to provide primary cooling for the rotor 100 and flow communication between the opposite rotor face chambers 101. As shown in FIGS. 1A, 1B and 5, the rotor gas channels 104 are arranged along the circumference and just radially inward of the outer circumferential surface 199 of the rotor. The size, number and spacing of the rotor gas channels 104, as well as the distance between the rotor gas channels 104 and the outer circumferential surface 199, are chosen so the rotor gas channels 104 provide an effective means for cooling the rotor 100 a desired amount at the outer circumferential surface 199 where much of the rotor's heat is concentrated. By properly removing such heat, thermal stresses and sealing feature distortions can be reduced. This is especially important for achieving the tight clearances required for the non-contact sealing design of the present invention.

FIGS. 1A and 4 depict the preferred embodiment of the rotor cooling system of the present invention in which rotor cooling gas is introduced at rotor cooling gas supply ports 402I, 402E in both cooling plates 400I, 400E but heated gas is removed at a rotor heated gas exit port 404E, in only cooling plate 400E. This embodiment is preferable because more rotor cooling gas is forced to flow through the rotor gas channels 104.

According to the embodiment of FIG. 4, a rotor cooling gas enters both rotor face chambers 101 near the axis of the rotor through rotor cooling gas channels 302I and 302E in respective adjacent end plates 300I and 300E, as indicated by arrows A. As a result of the centrifugal pumping phenomenon (and/or an induced pressure differential brought about by, for example, a blower), the rotating gas progresses radially outward along the rotor face as indicated by arrows B, while absorbing heat from the rotor 100. The now heated cooling gas leaves the rotor 100 through the rotor heated gas channels 304E disposed only in the exhaust end plate 300E as indicated by arrow C.

Note that the rotor cooling gas introduced into the rotor face chamber 101 through the rotor cooling gas channel 302I on the intake side mainly flows to the escape path through the heated gas channel 304E by first flowing through the rotor gas channels 104 as indicated by arrows D. Also, the rotor cooling gas flows axially through the vane slots 130 to cool and lubricate the vanes 120, vane slots 130, and vane slot rollers 133.

In other embodiments, a pump or blower can be used without centrifugal pumping, so that the rotor channels 104 need not be disposed radially outward of the rotor cooling gas channels 302. In the preferred embodiment, the centrifugal pumping illustrated in FIG. 4 is assisted by an external blower to force the rotor cooling gas axially through the rotor cooling gas channels 302 and rotor gas channels 104.

To increase the effectiveness of the centrifugal pumping, a blade or fin 103 may be formed on the face of the rotor 100 to increase the rotational acceleration of the rotor cooling gas in a rotor face chamber 101. The blade 103 may be a ridge oriented substantially radially.

The rotor heated gas channels 304E are advantageously positioned radially outward of the linear translation ring 310 so as to be radially outward of the rotor cooling gas channels 302E and 302I without interfering with the function of the linear translation ring 310. The rotor heated gas channels 304E need not entirely surround the linear translation ring 310, and FIG. 1A shows no rotor heated gas channels 304 along the scavenging section of the pumping machine. The rotor heated gas channels 304E are in flow communication with the rotor heated gas exit port 404E on the corresponding cooling plate 400E. A rotor heated gas chamber 405 may be recessed into the cooling plate 400E to provide flow communication between the rotor heated gas channels 304 and the rotor heated gas exit port 404E.

When, as in FIG. 1A, the rotor cooling gas is exhausted solely from one axial end, only one of the cooling plates 400E has a rotor heated gas exit port 404E. In the embodiment of FIG. 1B, rotor cooling gas enters the rotor area from both axial ends, through rotor cooling gas supply ports 402I, 402E, and exits through respective rotor heated gas exit ports 404I, 404E. More specifically, at one axial end of the machine 10' the rotor cooling gas would follow a flow path including the rotor cooling gas supply port 402I, rotor cooling gas channel 302I, rotor face chamber 101, rotor heated gas channel 304I, and rotor heated gas exit port 404I. At the other axial end of the machine 10', the rotor cooling gas would follow a flow path including the rotor cooling gas supply port 402E, rotor cooling gas channel 302E, rotor face chamber 101, rotor heated gas channel 304E, and rotor heated gas exit port 404E. Note that in the embodiment of FIG. 1B, the rotor cooling gas does not flow significantly through the rotor gas channels 104. As stated above, preferably only one rotor heated gas exit port 404 is provided at one axial end of the machine in order to force the rotor cooling gas to pass through the rotor gas channels 104 as in FIG. 1A.

As shown in FIG. 4 and FIG. 5, sealing lips 102 are formed along the outer circumferential surface 199 of the rotor 100 and extend axially toward the adjacent plate, here an end plate 300. The sealing lips 102 are formed to substantially prevent hot compressed or combusted gases in the vane cells 140 from seeping into the rotor face chamber 101, substantially lowering efficiency, and perhaps even damaging the structures bordering the rotor face chamber 101 such as the linear translation channels 330 and vane slots 130 (see FIG. 2). Simultaneously, these sealing lips 102 substantially prevent cooling gas flowing along the rotor face chambers 101 (arrow B in FIG. 4) from seeping into the vane cells 140 of the machine.

Because of these sealing lips 102, lubricants (e.g., a lubricant mist) can be added to the rotor cooling gas without contaminating the fluid (e.g., a fuel mixture) in the vane cells 140 of the machine. Such a lubricant can lubricate the moving parts in contact with the rotor face chambers 101, such as the vane slot rollers 133 in the vane slots 130, the bearings 333 of shuttle cages 350 in the linear translation channels 330 of the linear translation ring 310, the bearings 113 around the rotor shaft 110, and the bearings 123 around the hub 320, all shown in FIG. 2. A lubricant mist is the preferred method of lubricating high speed rolling bearings. Also, rolling bearings require less lubricant than sliding or journal bearings, thus lower concentrations of mist can be used which reduces the chances for polluting the environment. This synergistic rotor cooling arrangement and unique geometry therefore simultaneously solve two problems: first, cooling the moving parts associated with the rotor; and second, lubricating those moving parts without using large amounts of lubricating liquids that can pollute the environment.

To maintain the sealing lips 102 in close sealing proximity with the adjacent end plate 300, without excessive wear on the lips 102, a thrust bearing 170 is disposed between the rotor 100 and each adjacent end plate 300, close to the rotor shaft 110 and radially inward of the rotor cooling gas channels 302 that introduce cooling gas into the rotor face chambers 101. In this position, the thrust bearings 170 provide tight control over the axial seal gap, i.e., the gap between the sealing lips 102 and the adjacent end plate 300. This control can be maintained even when the rotor outer circumferential surface 199 is exposed to the high temperatures of a rotary vane pumping combustion engine (10 in FIG. 1). The thrust bearing 170 is desirably positioned radially inward of the rotor cooling gas channels 302 to allow the rotor cooling gas to flow freely into the rotor face chamber 101 and spread radially outward as shown by arrows A and B in FIG. 4. The bearings of the thrust bearing 170 reduce the friction at the axial load bearing contact between the thrust bearing 170 and the hub 320 of the end plate 300. In the preferred embodiment, spherical or cylindrical rolling bearings are employed, and are lubricated by the mist mixed in the rotor cooling gas.

Note that FIG. 5 also shows that a portion of a reciprocating vane 120 extends into the rotor face chamber 101 between the sealing lips 102 and the thrust bearing 170. This portion of the vane 120 may itself serve as the blade (103 in FIG. 4) described earlier, which functions to increase the rotational acceleration of the rotor cooling gas in the rotor face chamber 101.

Figure 6:
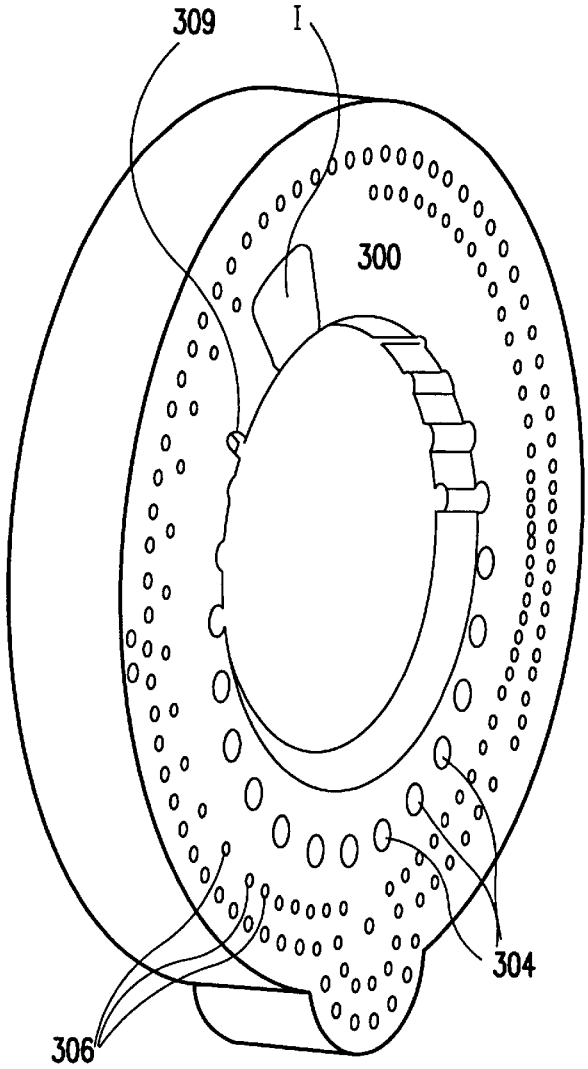
FIG. 6 is a perspective view of an end plate with a notch for releasing overpressure according to another embodiment of the present invention.

Because the seals of the sealing lips 102 are not completely gas proof, and because the pressures in vane cells 140 associated with compression and combustion may become extremely high, some gases may leak gradually into the rotor face chambers 101, creating an overpressure condition in the rotor face chamber 101. To prevent this buildup of overpressure, a small pressure release notch 309 is formed in the end plate 300 housing near the air intake I as shown in FIG. 6 (some of the features of which have been omitted for clarity) and FIG. 8. This allows gas to escape from the rotor face chamber 101, around the rotor sealing lips 102 and into a vane cell 140 at pressures much lower (e.g., pressures near ambient pressure) than in the vane cells undergoing combustion or compression. By placing the notch 309 at the intake side, any unburned fuel and lubricating mist in the escaping gas will be carried through a combustion cycle of the rotary vane engine, where it will be combusted before being discharged through the exhaust (e.g., E in FIG. 1). This reduces the pollution effects from the gas that is allowed to escape the rotor face chamber 101 to relieve the overpressure in a rotary vane engine 10.

Figure 7:
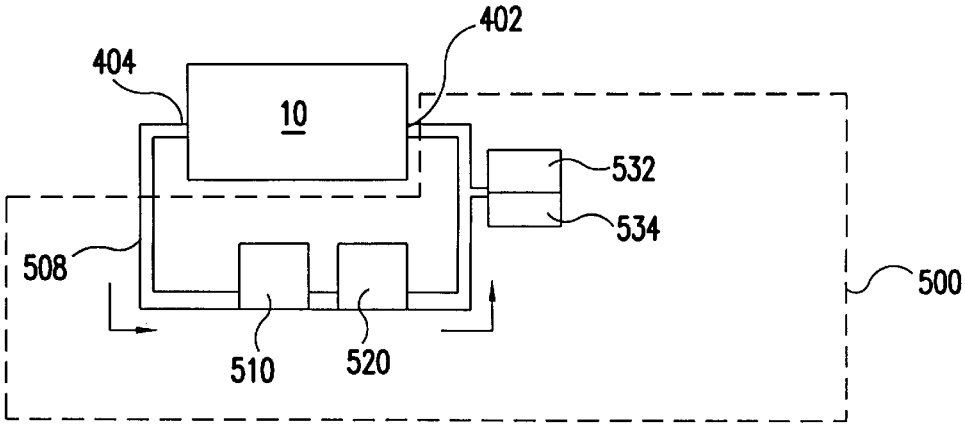
FIG. 7 is a schematic diagram showing the cooling gas supply portion with a recirculation pipe, according to another embodiment of the present invention.

Referring to FIG. 7, the gas discharged from the rotor heated gas exit port 404 may be recirculated to the rotor cooling gas supply port 402, after it is cooled. In this way, any gas discharged from the rotor heated gas exit port 404 that is laden with lubricant mist or leaked fuel vapors can be prevented from escaping to and polluting the atmosphere. The cooling gas recirculating portion 500 contains a recirculation pipe 508 connecting the rotor heated gas exit port 404 on one axial side of a rotary vane engine 10 with a rotor cooling gas supply port 402 on the other axial side of engine 10. The gas passes out of the rotor heated gas exit port 404 through a heat exchanger 510, which dissipates heat and lowers the temperature of the gas, and then flows into the rotor cooling gas supply port 402 in the direction of the arrows. An external cooling gas supply pump 520, such as a blower, may be provided to enhance axial flow through the engine 10. The recirculating portion 500 also includes a component gas supply 532, such as an air supply, and a lubricating mist supply 534, which may be combined to constitute the rotor cooling gas that is in flow communication with the rotor cooling gas supply port 402 through the recirculation pipe 508. Regarding the lubricating mist, note that certain liquid fuels, such as certain grades of diesel or kerosene, may provide sufficient viscosity to double as the lubricating mist of the present invention.

Figure 8:
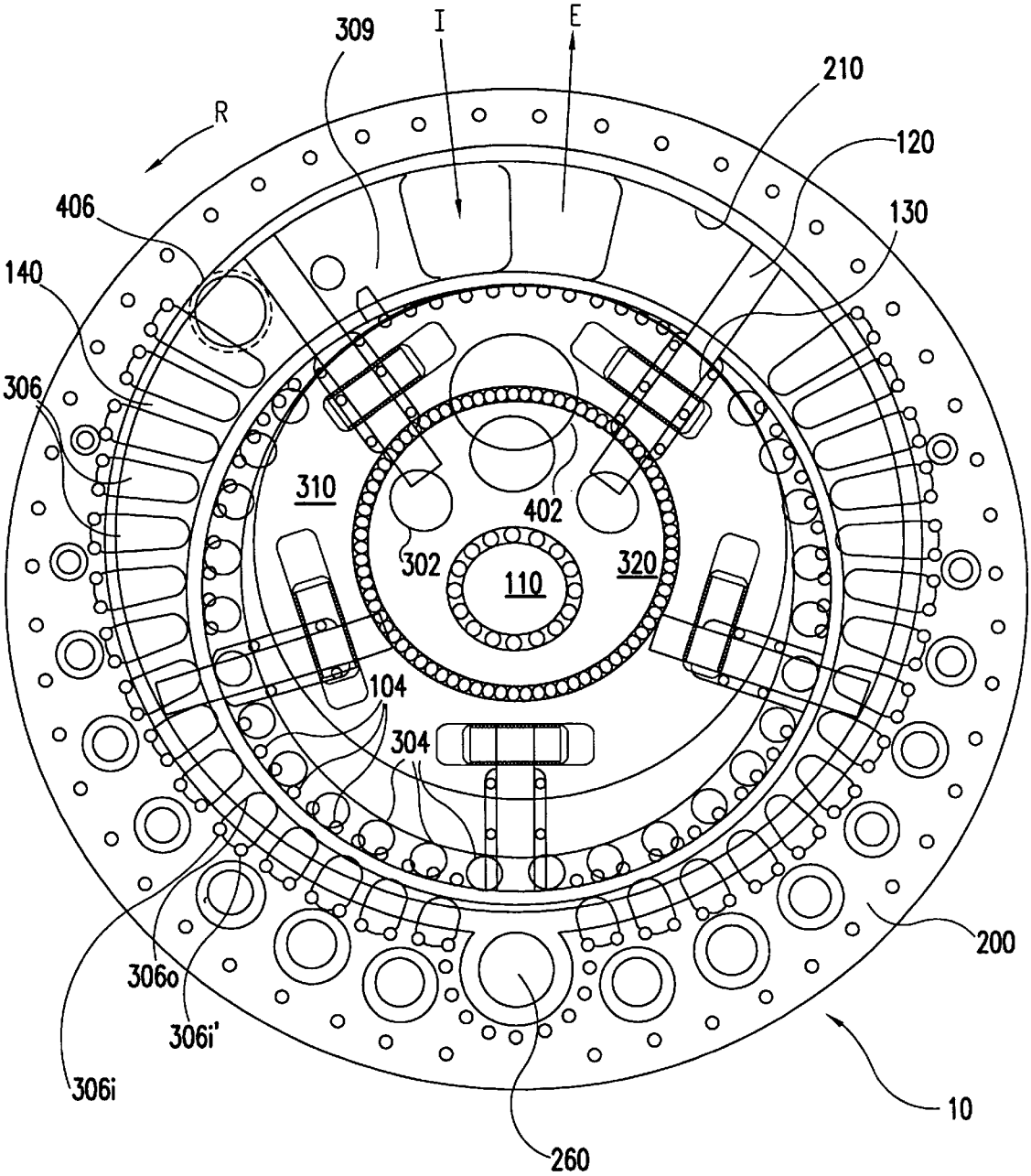
FIG. 8 is an overlay end view showing relative radial positions of structures in the rotor, the stator assembly, an end plate, and a cooling plate according to the embodiment of FIG. 1A.

FIG. 8 shows an overlay of several end views to illustrate the relative radial and axial positions of some of the recited structures in the FIG. 1A embodiment of the cooling system. Relative radial positions are referenced with respect to the center of the rotor axis 110. Also, the end view may be with reference to either end of the machine.

As shown in FIG. 8, the rotor cooling gas supply port 402 of a cooling plate 400 is positioned to facilitate flow communication with the rotor cooling gas channels 302 in the end plate. The rotor cooling gas channels 302 are located in the hub 320 of the end plate, radially inward of the linear translation ring 310 so as to avoid interference with the rotation of the ring 310.

Rotor gas channels 104 in the rotor are disposed farther from the center of the rotor axis 110 than are the rotor cooling gas channels 302, i.e., radially outward from the rotor cooling gas channels 302, consistent with cooling the outer edge of the rotor while taking advantage of the centrifugal pumping phenomenon.

The end plate also includes rotor heated gas channels 304 which are disposed radially outward from the rotor cooling gas channels 302 to coincide with the radial positions of the rotor gas channels 104. Furthermore, the rotor heated gas channels 304 are disposed radially outward of the linear translation ring 310. In the depicted positions, the rotor heated gas channels 304 are positioned to facilitate flow communication with the rotor gas channels 104 as the rotor 100 rotates and the rotor gas channels 104 move past the rotor heated gas channels 304, without interfering with the linear translation ring 310, which is also rotating.

Stator Assembly and End Plate Cooling System

The cooling of the stator assembly 200 and the end plates 300 will now be described. According to the present invention, and referring to either FIG. 1A or FIG. 1B, the stator assembly 200 is cooled using a cooling fluid which can be either a gas such as air or a liquid such as water. The stator/end plate cooling system delivers the cooling fluid from outside the rotary vane pumping machine to the vicinity of the stator cavity boundary 210.

As with the rotor cooling, the stator/end plate cooling will be described in terms of channels formed through the various parts of a rotary vane pumping machine, as embodied in a rotary vane engine 10. A useful frame of reference is provided by recognizing that the channels connect ports on the cooling plates 400 with the stator assembly 200. Thus the channels carry the cooling fluid axially through the pumping machine.

The stator and end plate cooling fluid (hereinafter referred to as "stator cooling fluid" for simplicity) passes axially in a single overall direction through the rotary vane pumping machine. One of ordinary skill in the art would understand that within this axial flow along the single overall direction, the cooling fluid may at times reverse flow direction if required. In the embodiment of FIG. 1A, the stator cooling fluid supply port can be either the intake side fluid port 406 or the exhaust side fluid port 407, but for simplicity, we will assume the cooling fluid flows from the intake fluid port 406 to the exhaust fluid port 407. Generally, the stator cooling fluid enters at stator cooling fluid supply port 406 in cooling plate 400I, passes through end plate cooling fluid channels 306 in end plate 300I, flows through stator fluid channels 206 in the stator assembly 200, and exits at a stator cooling fluid exit port 407 in the other cooling plate 400E, via end plate heated fluid channels 307 in the other end plate 300E. The cooling fluid thus absorbs heat in the stator 200 and end plates 300 during its axial flow through the engine. These features are described in more detail below.

Each stator cooling fluid port 406, 407 is in flow communication with a plurality of end plate fluid channels 306, 307 in the adjacent end plates 300I, 300E. The flow communication may be established using a fluid chamber 409 in each endplate 400I, 400E. An island 408, shown within the fluid chamber 409 of the exhaust side cooling plate 400E, may also be included so that access to the combustion residence chamber 260 can be obtained through the cooling plate 400 without disrupting the flow of the stator cooling fluid.

The end plate cooling and heated fluid channels 306, 307 are configured so that each has a greater axial cross sectional area at an outer end in contact with an adjacent cooling plate 400 than at an inner end in contact with the stator assembly 200. In other words, the cross sectional area of the end plate cooling and heated fluid channels 306, 307 varies as one progresses along the axis of the engine. For example, FIG. 1A shows the outer end of each intake side end plate cooling fluid channel 306 is larger than a corresponding inner end, shown for the exhaust side end plate heated fluid channel 307.

As shown in FIG. 5 and the end view overlay of FIG. 8, an outer end 306*o* of the end plate cooling fluid channel 306 has a larger cross sectional area than an inner end 306*i*. In this example, the inner end 306*i* of each end plate cooling fluid channel 306 has a second separate small opening 306*i*'. The inner ends 306i of the cooling fluid channels 306 should have approximately the same cross sectional area as the stator fluid channels 206 (FIG. 5) so as to provide flow communication there between without spilling cooling fluid into the vane cells between the stator assembly 200 and the rotor 100. The stator fluid channels 206 are formed axially through the stator assembly 200 near the inward edge of the assembly 200 that defines the boundary of the stator cavity 210. The number, size and spacing of the stator fluid channels 206 are chosen to effectively carry away the heat transmitted into the stator assembly 200 from the vane cells 140. For example, the stator fluid channels 206 can be formed to keep the temperature of the stator assembly 200 substantially uniform, even though heat sources are not uniformly distributed around the stator cavity 210. In the embodiments of FIG. 1A and FIG. 5, the stator fluid channels 206 are arranged only along a portion of the inner radial edge of the stator assembly 200 where the greatest heat production is expected to occur. In addition, the distance from the stator fluid channel 206 to the inner radial edge of the stator assembly 200 is spaced to effectively absorb the heat transmitted to that portion of the stator assembly 200.

The outer ends 306*o* of the end plate cooling and heated fluid channels 306, 307 may be much larger than the stator fluid channels 206, and can be selected to effectively carry heat from the axial ends of the vane cells 140, or just to facilitate flow communication with the stator cooling fluid supply and exit ports 406, 407 or both. For the first purpose, the end plate cooling fluid channels 306 would retain the wide cross section of the outer end 306*o* deep into the end plate 300 before narrowing to the cross section of the inner end 306*i*. Also, as shown in FIG. 8, the radial extent of the cross sections of the outer end 306*o* may vary with azimuthal angle in the direction of rotation R, to match the radial extent of the vane cell at that angle.

As shown in FIG. 5, the stator fluid channels 206 include a combustion subset of stator fluid channels 206* disposed around the combustion residence chamber 260 to effectively absorb heat transmitted from the combustion chamber 260. Consequently, the end plate cooling and heated fluid channels 306, 307 would also include a combustion subset of cooling fluid channels, e.g. 306*, to provide flow communication with the combustion subset of stator channels 206*, without introducing stator cooling fluid to the combustion residence chamber 260.

FIG. 8 shows the relative radial positions of some of the structures of the stator assembly cooling mechanism, which provide effective cooling without interfering with the operation of the engine. The stator cooling fluid supply port 406 of a cooling plate 400 is positioned to facilitate flow communication with the end plate cooling fluid channels 306 in the end plate. The end plate cooling fluid channels 306 are located radially outward of the rotor heated gas channels 304 in the end plate to avoid interference with the rotor cooling mechanism. To avoid interference with the vane cells 140, the inner ends 306*i* of the end plate cooling fluid channels 306 are located radially outward of the vane cells 140 and coincident with the stator fluid channels 206 (not separately labeled in this view). However, to increase heat exchange between the stator cooling fluid and the axial walls of the vane cells 140, the outer ends 306*o* of the cooling fluid channels 306 are extended radially to match the radial extent of the vane cells 140 at each azimuthal angle in the direction of rotation R.

Using the rotor cooling gas or stator/end plate cooling fluid, or both, according to the rotor and stator assembly cooling system of the present invention, the rotating rotor and stator of a rotary vane pumping machine can be cooled without interfering with the complex moving interactions of the machine, even when the machine is a rotary vane internal combustion engine. In addition, the rotating parts can be cooled. without complex rotating cooling seals, and the rolling bearings can be properly lubricated using the same rotor cooling gas.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. A rotary vane pumping machine, comprising:

a first end plate and a second end plate;

a rotor rotating around a rotor shaft axis and within a stator, the rotor being located between the first and second end plates, with the rotor shaft extending through each of the first end plate and second end plate, wherein an outer circumferential surface of the rotor comprises an annular sealing lip extending axially toward respective of the first end plate and the second end plate; and thrust bearings surrounding the rotor shaft and disposed between the rotor and respective of the first end plate and second end plate, thereby preventing contact between the annular sealing lip and each of the first and plate and the second end plate.

* * * * *